US007472798B2

(12) United States Patent
Stowitts

(10) Patent No.: US 7,472,798 B2
(45) Date of Patent: Jan. 6, 2009

(54) POLYGONAL HOUR-GLASS HOT-FILLABLE BOTTLE

(75) Inventor: Adam P. S. Stowitts, Arvada, CO (US)

(73) Assignee: Ball Corporation, Broomfield, CO (US)

( * ) Notice: Subject to any disclaimer, the term of this patent is extended or adjusted under 35 U.S.C. 154(b) by 176 days.

(21) Appl. No.: 11/504,170

(22) Filed: Aug. 15, 2006

(65) Prior Publication Data

US 2008/0041812 A1 Feb. 21, 2008

(51) Int. Cl.
*B65D 1/42* (2006.01)

(52) U.S. Cl. ..... 215/381; 220/669; 220/675

(58) Field of Classification Search ..... 215/381, 215/384, 900; 220/666, 669, 675
See application file for complete search history.

(56) References Cited

U.S. PATENT DOCUMENTS

| | | | |
|---|---|---|---|
| D168,312 | S | 12/1952 | Linnard |
| D178,258 | S | 7/1956 | North |
| D178,259 | S | 7/1956 | North |
| D191,641 | S | 10/1961 | Du Pree |
| D203,884 | S | 2/1966 | Wood |
| D214,973 | S | 8/1969 | St. Amand |
| D269,950 | S | 8/1983 | Walker |
| D275,267 | S | 8/1984 | Gautier |
| D294,679 | S | 3/1988 | Griesing et al. |
| 4,863,046 | A | 9/1989 | Collette et al. |
| 4,890,752 | A | 1/1990 | Ota et al. |
| D308,482 | S | 6/1990 | Wild |
| D328,245 | S | 7/1992 | Noble |
| 5,199,588 | A | 4/1993 | Hayashi |
| D337,522 | S | 7/1993 | Kingsbury |
| 5,381,910 | A | 1/1995 | Sugiura et al. |
| D406,532 | S | 3/1999 | Black |
| 5,971,184 | A | 10/1999 | Krishnakumar et al. |
| D422,504 | S | 4/2000 | Fleishman |
| 6,145,681 | A | 11/2000 | Chimetto et al. |
| D434,668 | S | 12/2000 | Chimetto et al. |
| 6,213,326 | B1 * | 4/2001 | Denner et al. ..... 215/383 |
| D448,306 | S | 9/2001 | De Giovellina |
| D455,966 | S | 4/2002 | Patterson |
| D459,234 | S | 6/2002 | Bourque et al. |

(Continued)

FOREIGN PATENT DOCUMENTS

EP 1561691 A1 * 8/2005

(Continued)

*Primary Examiner*—Sue A Weaver
(74) *Attorney, Agent, or Firm*—Brinks Hofer Gilson & Lione

(57) ABSTRACT

A blow-molded container has a base with a polygonal perimeter. A lower margin joins the base to a side wall extending upward to an upper margin. A shoulder extends upward and axially inward above the upper margin to a finish defining an opening for a closure. The upper and lower margins of the side wall having a plurality of horizontal linear segments joined together by corner portions. An even number of horizontally adjacent planar segments are joined together to define a polygonal waist located between the upper and lower margins. A vacuum responsive panel is situated between each of the linear segments of the upper and lower margins and an aligned waist planar segment. Lateral edges of each vacuum responsive panel are joined by generally vertical, axially converging surfaces extending between each margin corner portion and an aligned planar segment of the waist.

16 Claims, 4 Drawing Sheets

U.S. PATENT DOCUMENTS

| | | | | |
|---|---|---|---|---|
| D459,995 | S | 7/2002 | Hong et al. | |
| D467,507 | S | 12/2002 | Bryant et al. | |
| 6,575,320 | B2 * | 6/2003 | Ota et al. | 215/381 |
| 6,575,321 | B2 | 6/2003 | Bourque et al. | |
| 6,637,613 | B2 | 10/2003 | Shimada et al. | |
| 6,749,075 | B2 | 6/2004 | Bourque et al. | |
| 2005/0218107 | A1 * | 10/2005 | Sabold et al. | 215/382 |
| 2006/0207962 | A1 * | 9/2006 | Coley et al. | 215/384 |

FOREIGN PATENT DOCUMENTS

| | | | | |
|---|---|---|---|---|
| JP | 0920323 | A | * | 1/1997 |
| JP | 2001315741 | A | * | 11/2001 |
| JP | 2002326619 | | * | 11/2002 |
| JP | 2004250055 | A | * | 9/2004 |
| JP | 2005008153 | A | * | 1/2005 |

* cited by examiner

POLYGONAL HOUR-GLASS HOT-FILLABLE BOTTLE

BACKGROUND OF THE INVENTION

The present invention relates to blow-molded plastic bottles useful in containing hot-filled beverages. The present invention relates particularly to single serve hot-fill containers that are readily grippable by one hand placed about the container sidewall.

Plastic blow molded containers have previously been provided with an inwardly extending grip that facilitates handling of the container during dispensing of its contents. The inwardly extending construction of the grip also provides a more rigid construction after the container is opened so that the gripping of the container can be maintained with less flexing. For example, Young, U.S. Pat. No. 5,732,838, discloses a plastic container having an inwardly extending lower annular grip section having depressions spaced about a central axis of the container. Each depression has a lower blunt end, an upper generally pointed end, and an intermediate portion having sides that taper toward each other in an upward direction. The lower location of the annular grip section facilitates manual grasping of the bottle when initially grasped from a horizontal support surface while the tapering configuration of the depressions facilitates manual fingertip gripping of the container by varying hand sizes. Young does not disclose any structure designed to accommodate the vacuum that typically develops in a container subsequent to capping the container that has been filled with a hot liquid.

U.S. Pat. Nos. 4,497,855; 5,971,184; and 6,044,996 are representative of patents disclosing containers specifically designed for hot fill applications. The containers typically have a plurality of panels spaced around the sidewall of the container that are designed to flex inward in response to the vacuum that typically develops in a container subsequent to a hot filling and capping operation. The vacuum responsive panels are separated by vertical supporting structures such as posts or lands that generally define the maximum sidewall radius measured from the axis of the container. The vacuum responsive panels are generally initially positioned at a non-protruding position as compared with the vertical posts or lands. The vacuum responsive panels move inwardly in response to, and to compensate for, an increasing vacuum within the container. While the inward movement is intended to be the same for all panels around the perimeter of the container, even small differences in wall thickness or geometry can cause one or more of the posts or lands of the container to buckle. Special geometries for the posts or lands have been adopted to inhibit such buckling as shown, for example, in U.S. Pat. Nos. 4,863,046; 5,199,588; and 5,381,910. Still, the buckling problem persists.

Despite the various features and benefits of the structures of the forgoing disclosures, there remains a need for a container that can be hot filled and have a geometry that is readily grippable by one hand placed about the container sidewall. There further remains a need for such a container having a sidewall that effectively resists that buckling tendency of the vertical supporting elements. There is a further need for such a container that will resist any crushing action when gripped by one hand after container opening.

SUMMARY OF THE INVENTION

These several needs are satisfied by a blow-molded container having a base, a side wall extending upward from the base including a lower margin and an upper margin, a shoulder portion extending upward and axially inward above the upper margin of the side wall to a finish defining a opening adapted to accept a closure. The side wall has a plurality of planar segments defining a waist of the container. The plurality of planar segments defining the waist can be joined end to end so as to substantially form, in horizontal cross-section, a polygon. The upper and lower margins of the side wall can be defined by a plurality of horizontal linear segments joined together by corner portions. A vacuum responsive panel can be situated between each of the linear segments of the upper and lower margins and one of the planar segments of the waist that can be aligned with each margin linear segment. The vacuum responsive panels can be situated in vertical mirror symmetry relative to the waist. Lateral edges of each vacuum responsive panel are joined by generally vertical, axially converging surfaces extending between each margin corner portion and a vertically aligned planar segment of the waist.

The vacuum responsive panels are initially generally planar and include a dimple that can be positioned on the lateral midline of the panel adjacent to the planar segment defining the waist. The dimple acts as a deflection initiation point when the container is hot filled, capped and cooled so that the dimple progressively expands axially in response to increasing vacuum within the container. The vacuum responsive panels can extend from a point on the waist of the container toward the upper and lower margins of the side wall, the panels becoming laterally wider with increasing distance from the waist of the container. Outwardly projecting bumper portions can couple the upper and lower margins of the side wall to the adjacent structure. The bumpers can project outward beyond the upper and lower margins of the side wall and can be vertically and axially aligned with respect to each other.

One feature of the present invention is the use of vacuum responsive panels that define the majority of the surface area of the side wall of the container. The vacuum responsive panels are separated from each other by comparatively smaller structural elements formed by the waist structure and the vertically diverging surfaces that resist the compressive forces presented by the cooling liquid within the container. The compressive resistance of the waist structure also facilitates consumer handling of the container following opening.

Other features of the present invention and the corresponding advantages of those features will be come apparent from the following discussion of the preferred embodiments of the present invention, exemplifying the best mode of practicing the present invention, which is illustrated in the accompanying drawings. The components in the figures are not necessarily to scale, emphasis instead being placed upon illustrating the principles of the invention. Moreover, in the figures, like referenced numerals designate corresponding parts throughout the different views.

DESCRIPTION OF A PREFERRED EMBODIMENT

Figure 1:
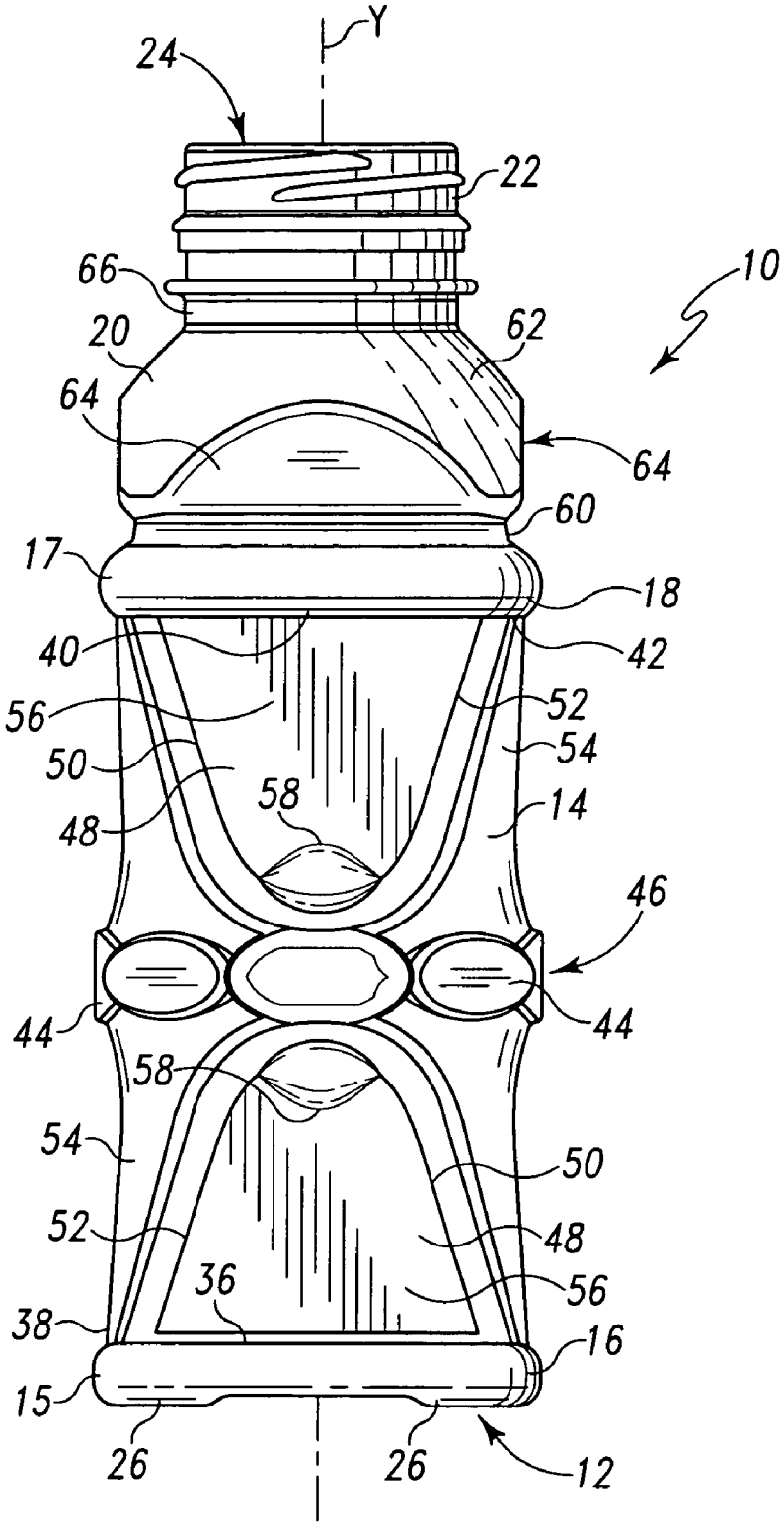
FIG. 1 is a side elevation view of a container embodying the present invention.

A. blow-molded container 10 is shown in FIGS. 1-4 to have generally a base 12 on which the container normally stands. A side wall 14 of the container 10 has a lower margin 16 joining the base 12. The side wall 14 extends upward from the base 12 to an upper margin 18. A shoulder portion 20 extends upward above the upper margin 18 and inward toward axis Y of the container 10 to a finish 22, surrounding a opening 24 leading to the interior of the container 10, the finish 22 being adapted to accept a closure, not shown.

Figure 2:
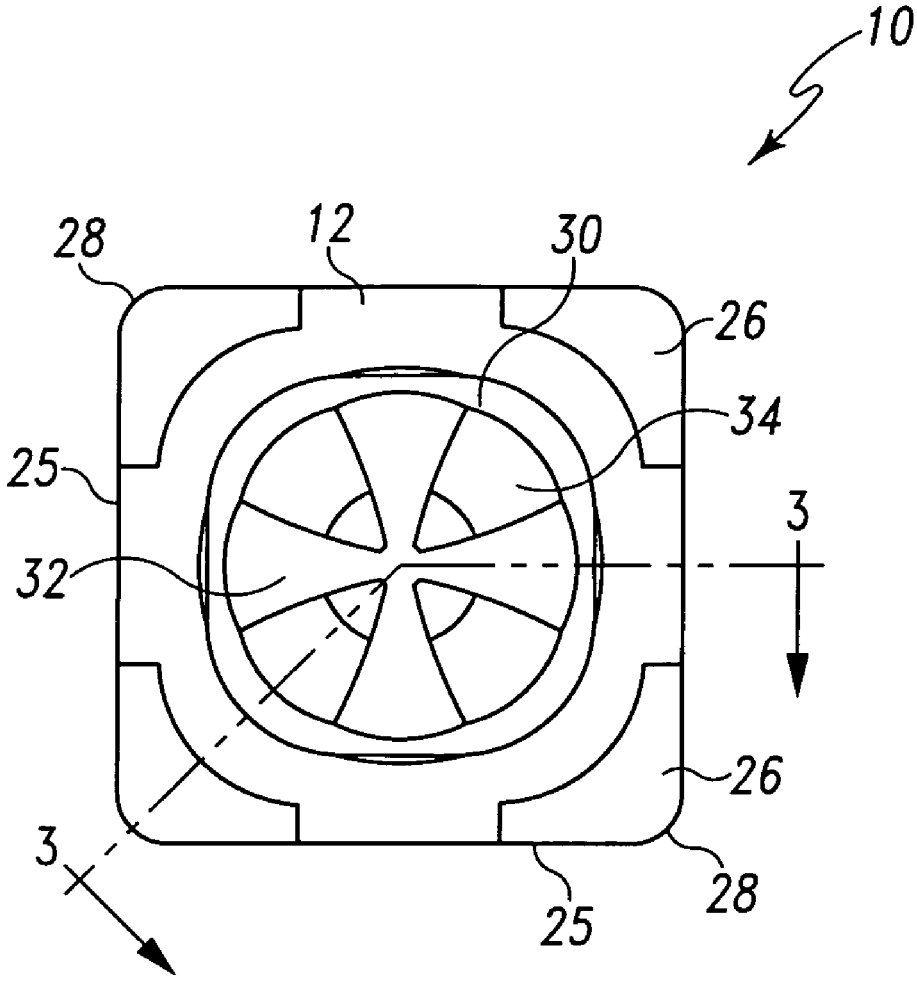
FIG. 2 is a bottom plan view of the container shown in FIG. 1.
Figure 3:
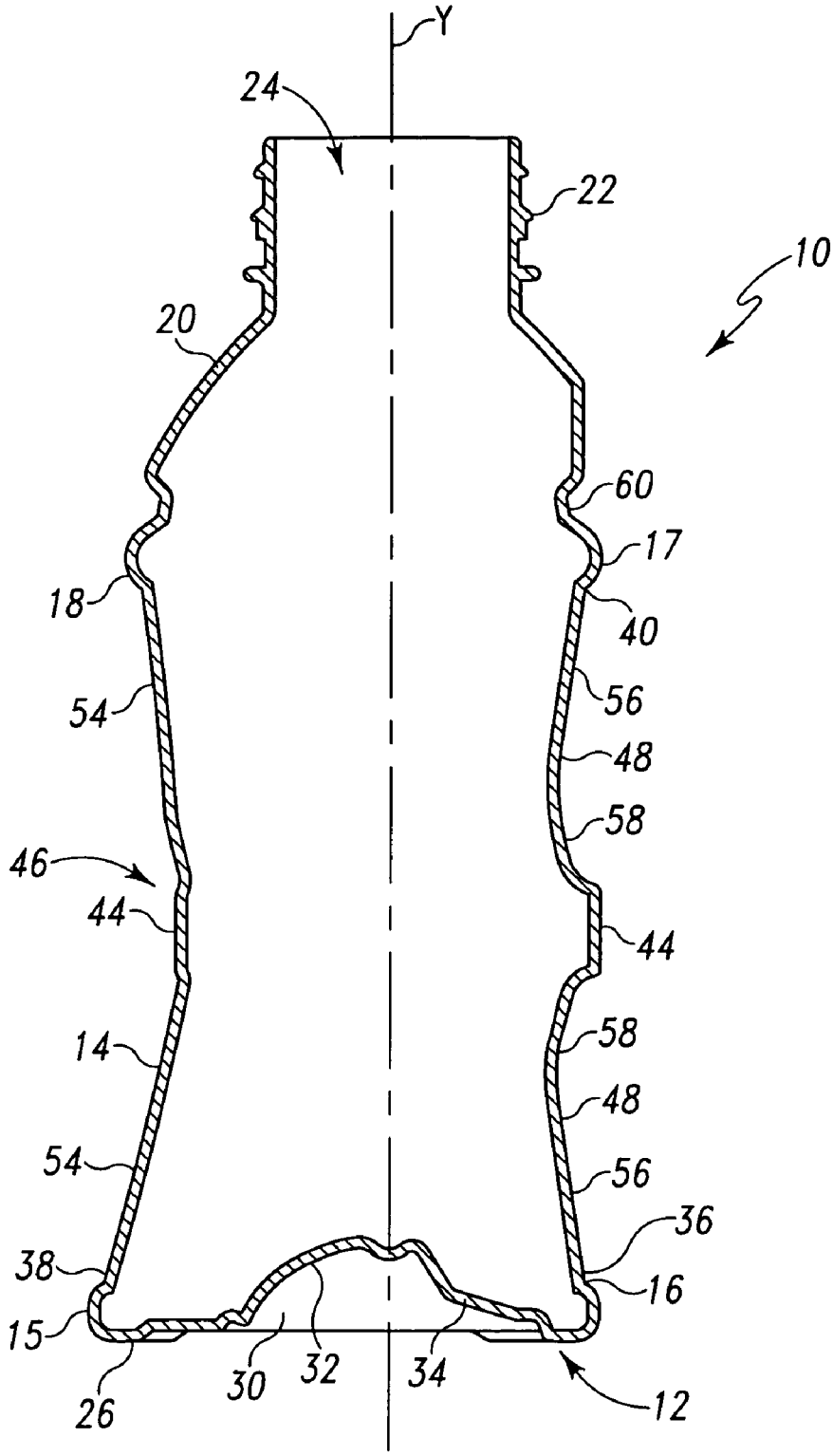
FIG. 3 is a vertical sectional view taken along line 3-3 of FIG. 2.

The base 12 is shown in FIG. 2 to have four sides 25, but the number of sides can vary from three to as many as eight. The base 12 can include downwardly extending feet 26 situated at the corners 28 that join the sides 25. The base 12 can also include a central portion 30 that is upwardly off-set above the feet 26 as shown FIG. 3. The central portion 30 of the base 12 can include a plurality upwardly domed segments 32 and angular ribs 34 that are interspersed with each other. Other base designs can also be used with the present container, which may include pressure or vacuum compensation areas.

The side wall 14 extends between the lower margin 16 and the upper margin 18. The lower margin 16 of the side wall 14, like the base 12 is shown to have four linear segments 36 continuously joined together end to end by four corner portions 38 so that the lower margin 16 is substantially square in horizontal cross-section. The lower margin 16 is generally formed to match the geometry of the base 12. Like the base 12, the number of linear segments 36 and corner portion 38 in the lower margin 16 can vary from three to as many as eight. The upper margin 18 of the side wall 14 is also shown to include including four linear segments 40 continuously joined together end to end by four corner portions 42 so that the upper margin 18 is substantially square in horizontal cross-section. The upper margin 18 can be formed to match the geometry of the lower margin 16, both in the number of segments 36, 40 and in the vertical alignment of the segments 36, 40. The segments 36, 40 can also be rotated or skewed with respect to each other around axis Y. The lower margin 16 of the side wall 14 can be coupled to the base 12 by a lower bumper portion 15 that projects outward from the lower margin 16. The upper margin 18 of the side wall 14 can be coupled to the shoulder 20 by an upper bumper portion 17 that projects outward from the upper margin 18. The lower margin 16 and upper margin 18 can be vertically and axially aligned with respect to each other.

The side wall 14 also is shown to include eight horizontally adjacent vertical planar segments 44 joined together to define an octagonal waist 46 located symmetrically between the upper margin 18 and lower margin 16. The number of vertical planar segments 44 forming waist 46 can be varied, but generally an even number of planar segments 44 is preferred. Each horizontal linear segments 36, 40 of the upper and lower margins 18, 16, respectively, can be oriented parallel to a corresponding one of the vertical planar segments 44 of the waist 46. It will be seen from FIG. 3 that the planar segments 44 can be vertically aligned with the outermost surfaces of the bumper portions 15 and 17. While the planar segments 44 are shown to be generally ovate in outline, other outline shapes can be used. The planar segments 44 preferably can be joined end to end to resist any radial compressive force on the waist 46.

Figure 4:
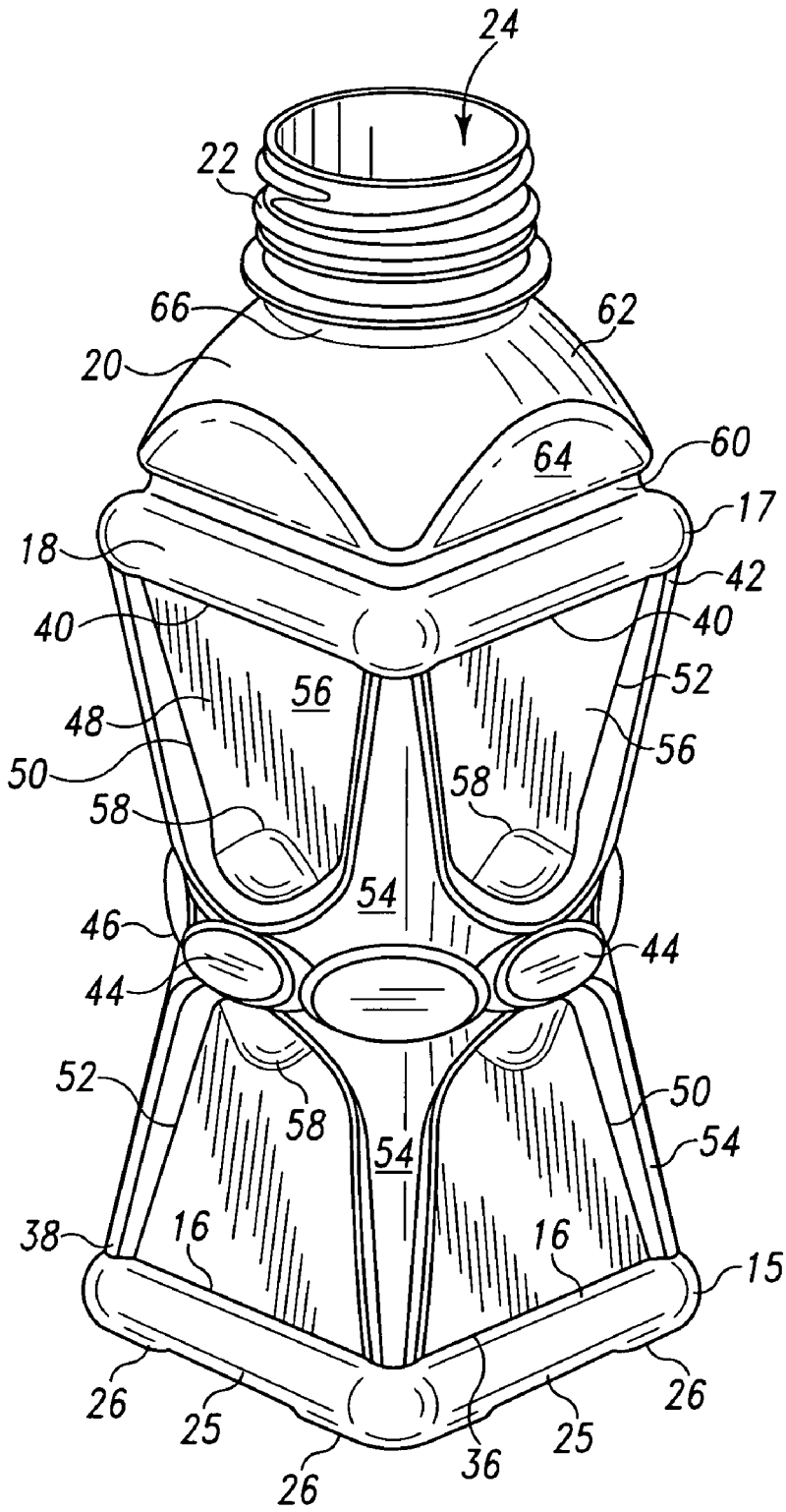
FIG. 4 is a perspective view of the container shown in FIGS. 1-3.

The side wall 14 also is shown to include a plurality of vacuum responsive panels 48. The vacuum responsive panels 48 are located between the planar segments 44 of the waist 46 and the linear segments 36, 40 of the upper and lower margins 18, 16, respectively. The vacuum responsive panels 48 can be situated in vertical mirror symmetry relative to the waist 46. The vacuum responsive panels 48 are shown to become laterally wider with increasing distance from the waist 46 of the container 10 toward the margins 16, 18. Lateral edges 50 and 52 of each vacuum responsive panel 48 can be joined by generally vertical, axially converging surfaces 54 that extend between each margin corner portion 38 and a vertically aligned planar segment 44 of the waist 46, giving the container 10 somewhat of an hour-glass appearance, as shown in FIG. 4. The vacuum responsive panels 48 can be inwardly depressed with respect to the adjacent generally vertical, axially converging surfaces 54 and planar segments 44. As shown best in FIG. 3, the vacuum responsive panels 48 can include a generally planar portion 56 adjacent the margin linear segment 36, 40, and a dimple 58 positioned on the lateral midline of the panel 48 adjacent the waist planar segment 44.

The shoulder portion 20 extends upward above the upper margin 18 and inward toward axis Y of the container 10. The shoulder portion 20 can be coupled to the upper margin 18 by an inwardly extending hoop ring 60. The shoulder portion can include an upwardly domed portion 62 and planar surface portions 64 that can be substantially vertical, and can be aligned with the linear segments 40 of the upper margin 18. The upwardly domed portion 62 can join a neck 66 leading to the finish 22 that surrounds the opening 24 leading to the interior of the container 10.

In operation, when the container 10 is hot-filled and capped, the dimple 58 in each vacuum responsive panel 48 progressively expands axially in response to increasing vacuum within the container 10, thereby providing a controlled, measured response to the thermally induced vacuum. The controlled, measured response of the vacuum responsive panels 48 effectively resists any buckling tendency of the vertical supporting elements 54 that was commonly experienced with other designs. At the same time, the planar segments 44 resist any radial movement, both under the influence of the thermally induced vacuum and any gripping pressure applied by a consumer.

While these features have been disclosed in connection with the illustrated preferred embodiment, other embodiments of the invention will be apparent to those skilled in the art that come within the spirit of the invention as defined in the following claims.

What is claimed is:

1. A blow-molded container comprising a base, a side wall having a lower margin joining the base, the side wall extending upward from the base to an upper margin, a shoulder portion extending upward and axially inward above the upper margin of the side wall to a finish defining a opening adapted to accept a closure, the upper and lower margins of the side wall having a plurality of horizontal linear segments joined together by corner portions, the side wall including an even number of horizontally adjacent planar segments joined together to define a polygonal waist located between the upper and lower margins, a vacuum responsive panel situated between each of the linear segments of the upper and lower margins and the planar segment of the waist aligned with each margin linear segment, with lateral edges of each vacuum responsive panel being joined by generally vertical, axially converging surfaces extending between each margin corner portion and a planar segment of the waist, each vacuum responsive panel having a generally planar portion adjacent the margin linear segment and a dimple adjacent the waist planar segment.

2. The blow-molded container of claim 1 wherein the vacuum responsive panels are depressed inward from said converging surfaces.

3. A blow-molded container comprising a base, a side wall having a lower margin joining the base, the side wall extending upward from the base to an upper margin, a shoulder portion extending upward and axially inward above the upper margin of the side wall to a finish defining a opening adapted to accept a closure, the upper and lower margins of the side wall having a plurality of horizontal linear segments joined together by corner portions, the side wall including an even number of horizontally adjacent planar segments joined together to define a polygonal waist located between the upper and lower margins, a vacuum responsive panel situated between each of the linear segments of the upper and lower margins and the planar segment of the waist aligned with each margin linear segment, with lateral edges of each vacuum responsive panel being joined by generally vertical, axially converging surfaces extending between each margin corner portion and a planar segment of the waist, wherein each vacuum responsive panel above the waist of the side wall extends upward to the upper margin and each vacuum responsive panel below the waist of the side wall extends downward to the lower margin.

4. The blow-molded container of either claim 1 or 3, wherein the upper margin and lower margin are substantially square in horizontal cross-section, and the waist is substantially octagonal in horizontal cross-section.

5. The blow-molded container of either claim 1 or 3, wherein each of the linear segments of the upper margin is parallel to one of the linear segments of the lower margin.

6. A blow-molded container comprising a base, a side wall having a lower margin joining the base, the side wall extending upward from the base to an upper margin, a shoulder portion extending upward and axially inward above the upper margin of the side wall to a finish defining a opening adapted to accept a closure, the upper and lower margins of the side wall having a plurality of horizontal linear segments joined together by corner portions, the side wall including an even number of horizontally adjacent planar segments joined together to define a polygonal waist located between the upper and lower margins, a vacuum responsive panel situated between each of the linear segments of the upper and lower margins and the planar segment of the waist aligned with each margin linear segment, with lateral edges of each vacuum responsive panel being joined by generally vertical, axially converging surfaces extending between each margin corner portion and a planar segment of the waist, wherein the generally vertical, axially converging surfaces taper from the waist planar segments to the corners, the corners being symmetrically spaced above and below the waist.

7. A blow-molded container comprising a base, a side wall having a lower margin joining the base, the side wall extending upward from the base to an upper margin, a shoulder portion extending upward and axially inward above the upper margin of the side wall to a finish defining a opening adapted to accept a closure, the upper and lower margins of the side wall having a plurality of horizontal linear segments joined together by corner portions, the side wall including an even number of horizontally adjacent planar segments joined together to define a polygonal waist located between the upper and lower margins, a vacuum responsive panel situated between each of the linear segments of the upper and lower margins and the planar segment of the waist aligned with each margin linear segment, with lateral edges of each vacuum responsive panel being joined by generally vertical, axially converging surfaces extending between each margin corner portion and a planar segment of the waist, wherein the shoulder portion is spaced from the side wall upper margin by an inwardly extending hoop ring.

8. The blow-molded container of any of claims 1, 3, 6 or 7, wherein the shoulder portion includes planar surface portions aligned with the upper margin linear segments.

9. A blow-molded container comprising a base, a side wall having a lower margin joining the base, the side wall extending upward from the base to an upper margin, a shoulder portion extending upward and axially inward above the upper margin of the side wall to a finish defining a opening adapted to accept a closure, the upper and lower margins of the side wall being substantially polygonal in horizontal cross-section and having a plurality of horizontal linear segments joined together by corner portions, the side wall including an even number of horizontally adjacent vertical planar segments joined together to define a polygonal waist located between the upper and lower margins, each horizontal linear segment of the upper and lower margins being oriented parallel to a corresponding one of the vertical planar segments of the polygonal waist, a vacuum responsive panel situated between each of the linear segments of the upper and lower margins and the corresponding planar segment of the waist, lateral edges of each vacuum responsive panel being joined by generally vertical, axially converging surfaces extending between each margin corner portion and a planar segment of the waist, wherein each vacuum responsive panel comprises a face depressed inward from said converging surfaces including a generally planar portion adjacent the margin linear segment and a dimple adjacent the waist planar segment.

10. The blow-molded container of claim 9 wherein each vacuum responsive panel above the waist of the side wall extends upward to the upper margin and each vacuum responsive panel below the waist of the side wall extends downward to the lower margin, each of the linear segments of the upper margin being aligned parallel to one of the linear segments of the lower margin.

11. The blow-molded container of claim 10 wherein the generally vertical, axially converging surfaces taper from the waist planar segments to the corners, the corners being symmetrically spaced above and below the waist.

12. The blow-molded container of claim 11 wherein the shoulder portion is spaced from the side wall upper margin by an inwardly extending hoop ring and includes substantially vertical, planar surface portions aligned with the upper margin linear segments.

13. The blow-molded container of claim 12 wherein the upper margin and lower margin are substantially square in horizontal cross-section, and the waist is substantially octagonal in horizontal cross-section.

14. A blow-molded container comprising a base, a side wall having a lower margin joining the base, the side wall extending upward from the base to an upper margin, a shoulder portion extending upward and axially inward above the upper margin of the side wall to a finish defining a opening adapted to accept a closure, the upper and lower margins of the side wall being substantially square in horizontal cross-section and having a plurality of horizontal linear segments joined together by corner portions, the side wall including eight horizontally adjacent vertical planar segments joined together to define an octagonal waist located symmetrically between the upper and lower margins, each horizontal linear segment of the upper and lower margins being oriented parallel to a corresponding one of the vertical planar segments of the octagonal waist, an inwardly depressed vacuum responsive panel situated between each of the linear segments of the upper and lower margins and the corresponding planar segment of the waist, each vacuum responsive panel extending substantially completely between a margin and the octagonal waist, lateral edges of each vacuum responsive panel being joined by generally vertical, axially converging surfaces extending between each margin corner portion and an aligned planar segment of the waist, wherein each vacuum responsive panel comprises a generally planar portion adjacent the margin linear segment and a dimple positioned on the lateral midline of the panel adjacent the waist planar segment, the dimple progressively expanding axially in response to increasing vacuum within the container.

15. The blow-molded container of claim 14 wherein each vacuum responsive panel becomes laterally wider with increasing distance from the waist of the container toward the margins.

16. The blow-molded container of claim 15 wherein the shoulder portion is spaced from the side wall upper margin by an inwardly extending hoop ring and includes substantially vertical planar surface portions aligned with the upper margin linear segments.

* * * * *